United States Patent [19]

Hoshihara

[11] Patent Number: 4,896,918

[45] Date of Patent: Jan. 30, 1990

[54] LUMBAR SUPPORT REGULATING APPARATUS

[75] Inventor: Naoaki Hoshihara, Nagoya, Japan

[73] Assignee: Aisin Seiki Kabushiki Kaisha, Aichi, Japan

[21] Appl. No.: 260,414

[22] Filed: Oct. 20, 1988

[30] Foreign Application Priority Data

Oct. 20, 1987 [JP] Japan ..... 62-160098

[51] Int. Cl.[4] ..... A47C 7/46

[52] U.S. Cl. ..... 297/284

[58] Field of Search ..... 297/284

[56] References Cited

U.S. PATENT DOCUMENTS

| | | | |
|---|---|---|---|
| 3,890,000 | 6/1975 | Easley | 297/284 |
| 4,019,777 | 4/1977 | Hayashi | 297/284 |
| 4,162,807 | 7/1979 | Yoshimura | 297/284 |
| 4,313,637 | 2/1982 | Barley | 297/284 |
| 4,465,317 | 8/1984 | Schwarz | 297/284 |
| 4,564,235 | 1/1986 | Hatsutta et al. | 297/284 |

FOREIGN PATENT DOCUMENTS

| | | |
|---|---|---|
| 56-10051 | 3/1981 | Japan . |
| 61-73615 | 4/1986 | Japan . |
| 61-226006 | 10/1986 | Japan . |

*Primary Examiner*—Peter R. Brown

*Attorney, Agent, or Firm*—Sughrue, Mion, Zinn, Macpeak & Seas

[57] ABSTRACT

A lumbar support regulating apparatus for a vehicle seat includes a pressing plate rotatably mounted on an offset portion of a rod, the opposite ends of which are rotatably mounted in opposite sides of a seat back frame so that upon rotation of the rod the pressing plate will be moved forwardly and rearwardly. A spiral spring is connected at its inner end to the rod with the outer end being connected to a link which is pivoted on the rod. The free end of the link is connected to a travelling nut which is threadedly mounted on a motor driven screw having suitable limit stops thereon so that upon rotation of the screw the travelling nut will pivot the link to rotate the rod through the spiral spring.

3 Claims, 5 Drawing Sheets

LUMBAR SUPPORT REGULATING APPARATUS

BACKGROUND OF THE INVENTION

The present invention relates to a lumbar support regulating apparatus and more particularly to a lumbar support regulating apparatus for vehicle and aircraft seats which regulates the firmness of a portion of the seat supporting the lumbar region of a seated person to improve the posture of the person.

Prior art apparatus of this type are disclosed in Japanese Patent Publication No. 56(1981)-10051, Japanese Patent Publication No. 61(1986)-73615 and Japanese Patent Publication No. 61(1986)-226006. In these prior art apparatus, a lumbar support member having a plate shape is rotatably supported by a rotatable shaft which extends laterally across the seat back thereby regulating the position of the lumbar support member and the pressing force on the lumbar region.

In Japanese Patent Publication No. 56-(1981)-10051, the wave shaped spring having a substantially S-shaped configuration is provided on a lumbar support portion and is forwardly and rearwardly removable. When the spring is moved forwardly and rearwardly, the configuration of the lumbar support portion is changed and the pressing force of the spring on the lumbar region of a human body is changed so that the hardness or firmness of the lumbar support portion is sensed the person is also changed. Since the durability of this type of spring is somewhat limited, it is necessary to restrict the degree of bending to a relatively small amount. As a result, the wave shaped spring having a large spring coefficient must be used. However, the amount of bending is restricted so the forward and rearward movable stroke of the lumbar support portion is quite small and the regulating range is very narrow. It is also possible with such a spring that a person seated on such a seat with the spring in its forward position will experience an unpleasant pain-like sensation due to the large spring coefficient.

In Japanese Patent Publication No. 61-(1986)-73615, the pressing member having a plate shaped is located in the lumbar support portion of the seat and a coil spring is disposed between the pressing member and a regulating member for regulating the position of the pressing member and the distance from the rotational center of the pressing member to the operating line of force of the coil spring is changed, thereby changing the spring coefficient of the lumbar support portion. However, the amount of movement of the pressing member is fairly large in the non-loaded state so that the posture of a seated person cannot be significant changed.

In Japanese Patent Publication No. 61-(1986)-226006, a pressing member having a plate shape is located in the lumbar support portion of the seat and the coil spring is interposed between the pressing member and a regulating member for regulating the position of the pressing member and the distance from the rotational center of the pressing member to the operating line of force of the coil spring is changed, thereby moving the pressing member forwardly and rearedly. However, when the receiving force on the pressing member from a seated person is large upon forward movement of the pressing member, it is necessary to use a coil spring having a large number of windings and a large diameter in order to obtain a fairly large change in posture regulation, and it is difficult to install such a coil spring within a seat back.

SUMMARY OF THE INVENTION

It is therefore an object of the present invention to provide a lumbar support regulating apparatus which obviates the aforementioned drawbacks associated with conventional apparatus of this type.

It is another object of the present invention to provide a lumbar support regulating apparatus which can regulate the posture over a wide range.

It is a further object of the present invention to provide a lumbar support regulating apparatus which is relatively small in size and a pressing portion which is relatively soft.

In accomplishing the above-mentioned and other objects, a lumbar support regulating apparatus according to the present invention includes a pressing member rotatably supported on a seat back frame for forward and rearward movement upon rotation thereof, drive means for rotating said pressing means and regulating means for said drive means including restricting means for restricting rotation of said pressing member, link means having one portion engaged with said drive means and rotatably supported on the seat back frame and a spiral resilient member having one end engaged with one portion of said link means and the other end engaged with the rotatable shaft upon which said pressing means is located.

The foregoing and other objects, features and advantages of the invention will be apparent from the following more particular description of a preferred embodiment of the invention as illustrated in the accompanying drawings.

BRIEF DESCRIPTION OF THE DRAWINGS

The above-stated objects and following description will become readily apparent with reference to the accompanying drawings in which.

DESCRIPTION OF A PREFERRED EMBODIMENT

Figure 1:
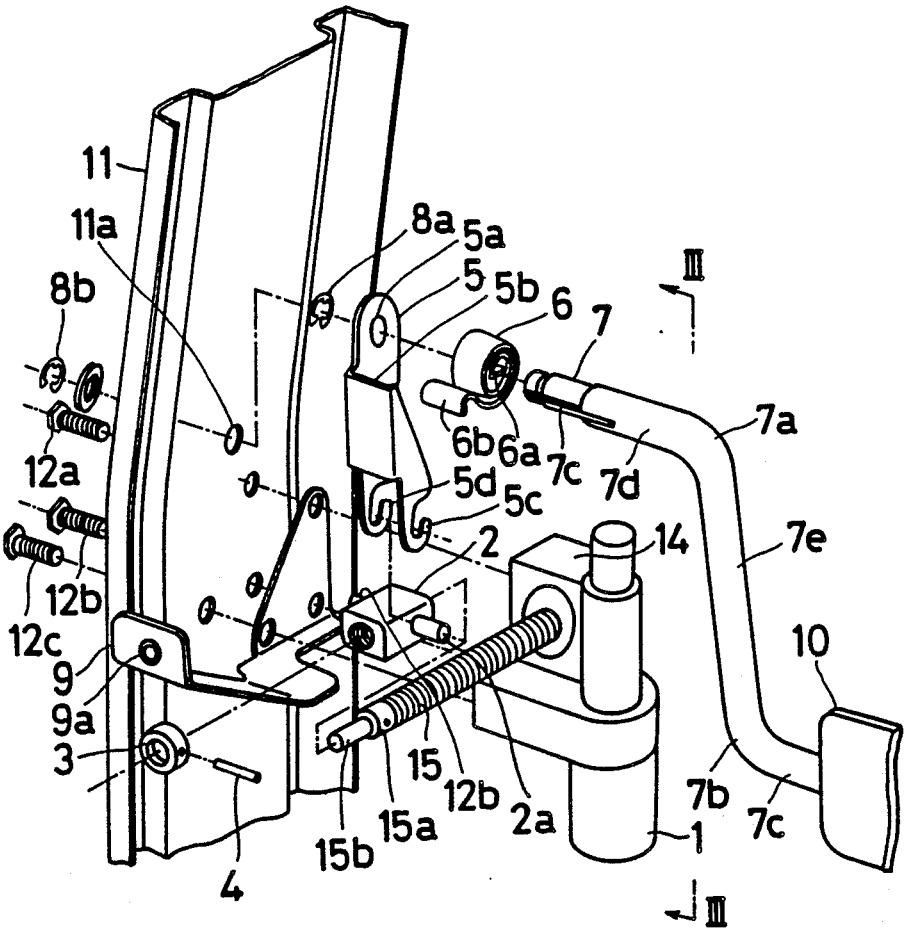
FIG. 1 is an exploded perspective view of an essential portion of a lumbar support regulating apparatus according to the present invention.
Figure 2:
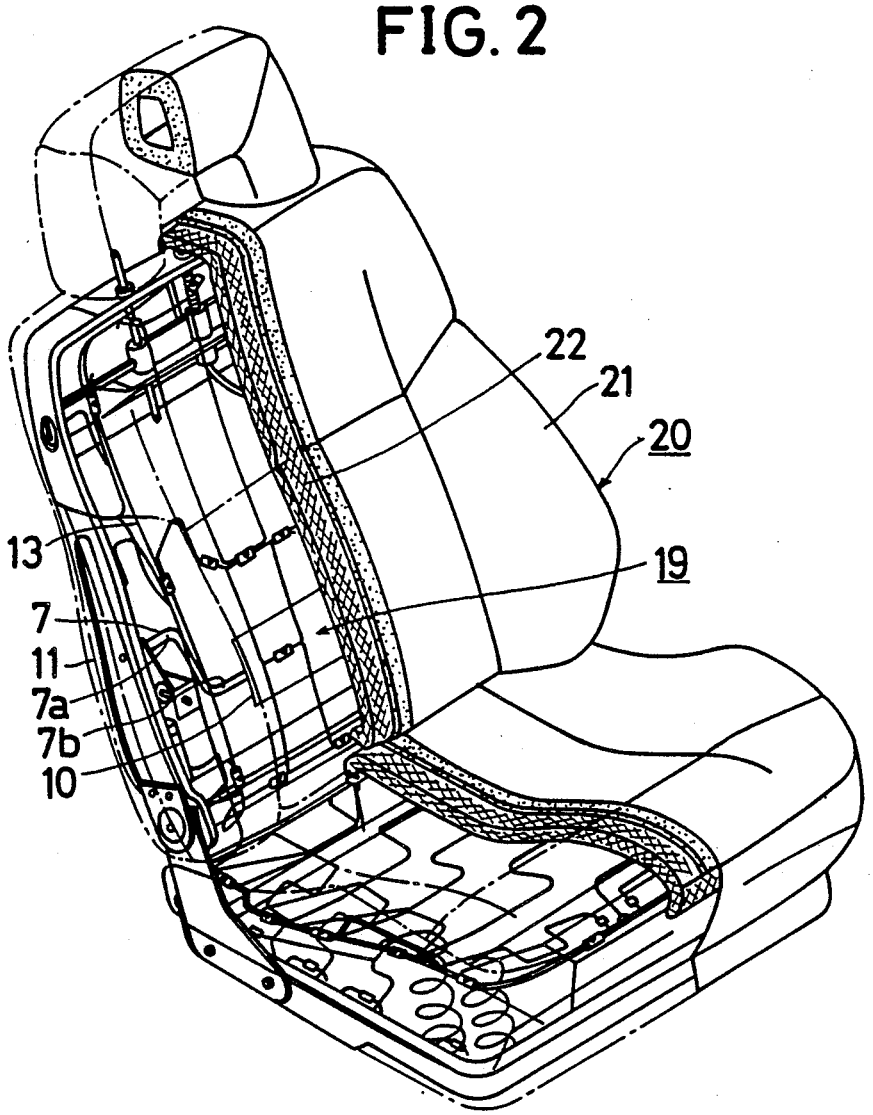
FIG. 2 is a partially broken away perspective view showing a seat for vehicles provided with the apparatus of FIG. 1.
Figure 3:
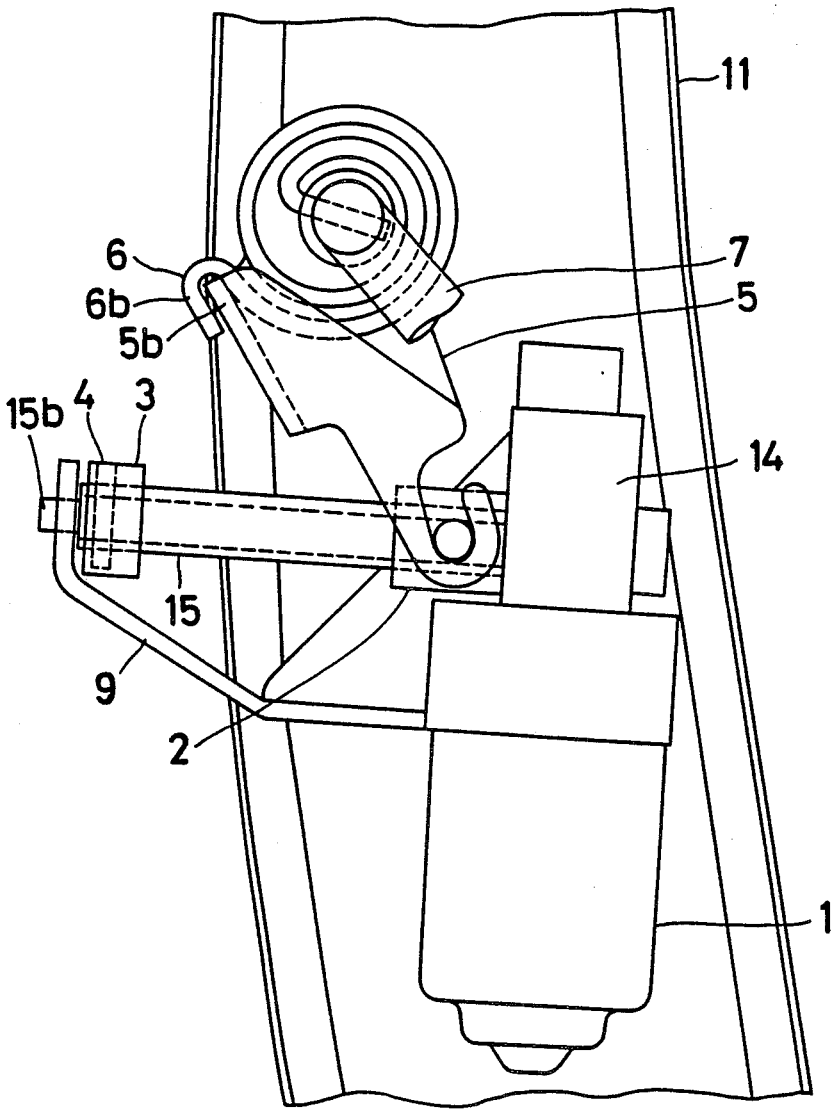
FIG. 3 is a sectional view taken along the line III—III in FIG. 1 with parts assembled.

The lumbar support regulating apparatus according to the present invention is used in combination with a seat of the type shown in FIG. 2. The seat 20 is a typical seat for a vehicle and is provided with a lumbar support regulating apparatus 19. A padded material 22 and a trim cover assembly 21 are shown in a cut away view. An exploded perspective view of the essential portion of the lumbar support regulating apparatus is shown in FIG. 1 and a cross sectional view of the lumbar support regulating apparatus 19 taken along the line III—III in FIG. 1 is shown in FIG. 3.

In FIG. 2, a pressing plate 10 is located in a region opposed to lumbar vertebrae of a person seated on the seat 20. The pressing plate 10 has a substantially flat rectangular configuration and is located transversely of the seat back. The front surface of the pressing plate 10 is disposed in contact with the padded material 22 and is supported on a rod 7 by a connecting portion (not shown) disposed on the rear surface thereof. The pressing plate 10 is rotatable relative to the rod 7.

The rod 7 is circular in cross section and is made from a metallic material. The rod 7 is shaped with an offset central portion upon which the pressing plate 10 is located. The offset central portion is formed by bending the rod 7 at four locations, *7a, 7b,* and two portions at the opposite end which have not been shown. The shape of the rod 7 is symmetrical to the central portion upon which the pressing plate is mounted so that the pressing plate 10 is disposed outwardly substantially parallel to the rotational axis of the rod 7.

The opposite ends of the rod 7 extends through holes 11*a* formed in opposite side portions of a seat back frame 11, so that the rod 7 and the pressing plate 10 are rotatably supported by the seat back frame. E-rings 8*a* and 8*b* are provided for securement on the ends of the rod 7 to prevent the ends of the rod 7 from pulling out of the side portions of the frame.

A spiral spring 6 is formed from a thin plate member with the inner end 6*a* thereof disposed transversely across the central portion of the spiral spring for engagement in a groove *7c* formed in one end of the rod 7. The spring 6 is supported completely on the rod 7 and a link 5 is rotatably mounted on the end of the rod 7 between the spiral spring 6 and the side portion 11 of the seat frame. The end of the rod 7 extends through a circular hole 5*a* in the upper end of the link 5. The link 5 is provided with an engaging tab having an edge 5*b* extending parallel to the axis of the rod 7. The outer most end of the spiral spring 6 is formed with a reversely bent portion 6*b* which engages the edge 5*b* of the link 5 as shown in FIG. 3. Therefore, the end 6*b* of the spiral spring 6 moves in accordance with the rotation of the link 5.

An electric motor 1 is provided for driving the lumbar support regulating apparatus 19. The drive shaft of the electric motor 1 is connected to rotate a screw 15 through a gear reduction mechanism 14. The threaded nut 2 is disposed in threaded engagement with the rod 15 whereby upon rotation of the screw 15 by the motor 1, the nut 2 will be moved along the longitudinal of the screw 15. A stop ring 3 is secured to the end 15*a* of the screw 15 by means of a pin 4 whereby the travel range of the nut 2 is limited by the reduction gear mechanism 14 and the stop ring 3.

The end 15*b* of the screw 15 extends through a whole 9*a* formed in a support bracket 9, which in turn is secured to the seat frame 11 by bolts 12*a*, 12*b*, and 12*c*.

The travelling nut 2 is formed with oppositely extending lateral projections 2*a* and 2*b* which are engaged in two hook-like projection 5*c* and 5*d* formed on a lower end of the link 5. Upon rotation of the screw 15 by the electric motor 1, the nut 2 is moved linearly along the axis of the screw 15 thereby rotating the link 5 about the end of the rod 7, to rotate the rod through the spiral spring 6 due to the engagement of the spiral spring 6 with the link 5. Accordingly, if the load applied to the pressing plate 10 does not change, the inner end 6*a* of the spiral spring 6 causes the rod 7 to rotate about the axis thereof. Rotation of the rod 7 about its axis causes the offset portion *7c* of the rod upon which the pressing plate 10 is located to follow a relatively large circular locus around the axis of the end portion *7d* of the rod 7.

Figure 5:
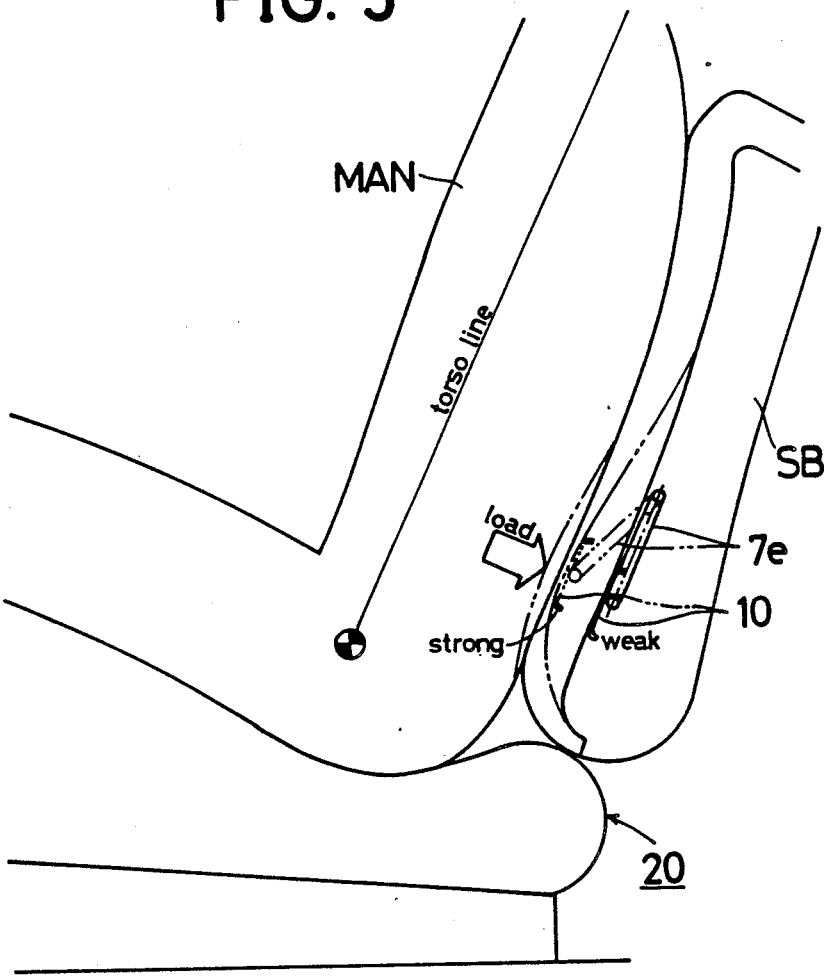
FIG. 5 is a side view showing a seat with a person seated thereon.

When the radially directed portion *7e* of the rod 7 is disposed perpendicular to the direction of the load provided by a seated passenger, as shown in FIG. 5, the travelling nut 2 will be disposed adjacent the reduction gear mechanism 14. When the travelling nut 2 is moved into engagement with the stop ring 3, the central portion *7c* of the rod 7 upon which the pressing plate 210 is mounted will be moved forwardly and the arm portion *7e* will be inclined relative to the plane of the seat back SB as shown by the chain and dotted line in FIG. 5. Thus, the degree of hardness or firmness sensed by a seat passenger will be determined in accordance with the regulated position of the pressing plate 10.

When the central portion *7c* of the rod 7 is pushed rearwardly of the seat by a force or load substantially tangent to the moving locus of the central portion *7c* for a predetermined stroke, the reaction force generated by the spring is fixed at every position. However, when the central portion *7c* of the rod 7 is disposed in the rear position as shown in solid lines in FIG. 5, the amount of force to move the pressing plate 10 is relatively small so that the rear position of the central portion *7c* of the rod 7 can be referred to as the weak position. When the central portion *7c* of the rod 7 is in the forward position as shown by the chain and dotted lines in FIG. 5, a relatively greater force is necessary to move the pressing plate 10 and accordingly, the forward position of the pressing plate 10 is referred to as the strong position. Thus, a seat passenger will experience a relative softness in the lumbar support area when the pressing member 10 is in the weak position and will experience a relative hardness or firmness when the pressing member is in the strong position. The pressing plate 10 is disposed in engagement with the padded material 22 and the load direction is essentially at right angles to the trim and cover assembly 21.

Figure 4A:
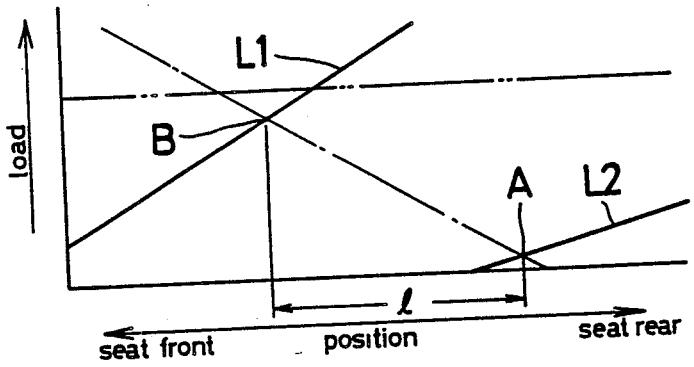
FIG. 4*a* is a diagram showing the load characteristics of the apparatus according to the present invention.
Figure 4B:
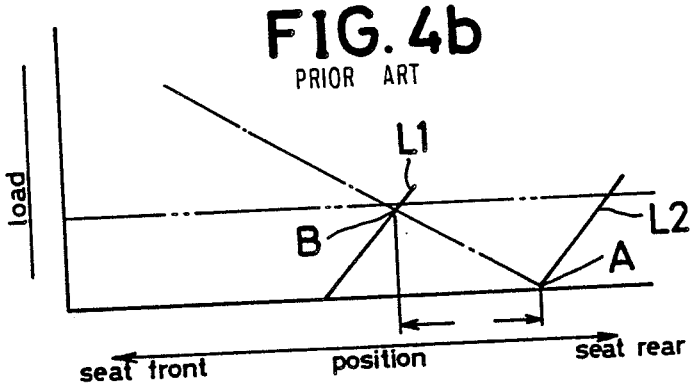
FIG. 4b PRIOR ART
FIGS. 4*b* 4*c* are diagrams showing representative load characteristics of two different conventional apparatus respectively.
Figure 4C:
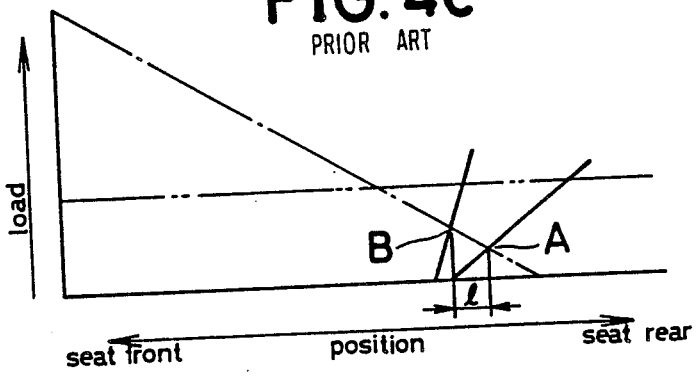
FIG. 4c PRIOR ART

FIG. 4*a* is a diagram showing the characteristics of the lumbar support regulating apparatus according to the present application. FIG. 4*b* is a diagram showing the characteristics of the lumbar support regulating apparatus as disclosed in Japanese Patent Publication No. 56(1981)-10051 and FIG. 4*c* is a diagram showing the characteristics of the lumbar support regulating apparatus of Japanese Patent Publication No. 61(1986)-73615. In each Figure, the relationship between the position of the pressing portion and the load is shown. The chain and dot line shows the size of the reaction force from a seated person over a range of positions for the pressing portion. The stroke 1 showing the regulating range of each apparatus is determined by the position change between an intersection point B of the characteristic line L1 and the chain and dot line of the reaction force and an intersection point A of the characteristic line L2 and the chain and dot line of the reaction force. Accordingly, it is clear from the diagrams that the regulating range of the apparatus according to the present embodiment as shown in FIG. 4*a* is substantially wider than the regulating range of the prior art apparatus. In FIG. 4*a* the inclination of the characteristic lines L1 and L2 are different, which indicates that the hardness or firmness of the pressing portion changes simultaneously upon performance of posture regulation. The small inclination of the characteristic lines indicates that the pressing portion is relatively soft.

As mentioned above, the present invention can provide posture regulation of the lumbar support over a wide range without having the pressing portion provide a hardness or firmness greater than that required. Since a spiral spring is used, the spring can be installed within a relatively small space and the apparatus can be miniaturized. Furthermore, since the forces required are reduced according to the present construction, the force tending to distort the seat back frame is reduced and accordingly, the strength of the seat back frame can also be reduced. Therefore, it is possible to substantially reduce the weight of the seat back frame.

It should be apparent to one skilled in the art that the above described embodiment is merely illustrative of but a few of the many possible specific embodiments of the present invention. Numerous and various other arrangements can be readily devised by those skilled in the art without departing from the spirit and scope of the invention as defined in the following claims.

What is claimed is:

1. A lumbar support regulating apparatus comprising:

pressing means rotatably supported on a seat back frame by means of rotatable shaft portions at opposite ends of an offset central portion having a pressing plate secured thereto for forward and rearward movement relative to said seat back frame upon rotation of said pressing means, a spiral spring member connected at a first end to and surrounding one of said rotatable shaft portions, link means pivotally mounted on said seat back frame disposed in engagement with a second end of said spiral spring member; and drive means mounted on said seat back frame for rotating said link means to rotate said pressing means through said spring member, said drive means including movable means connected to said link means and limit means on said drive means for limiting movement of said movable means for regulating the limit of forward and rearward movement of said pressing member.

2. A lumbar support regulating apparatus as set forth in claim 1, wherein said drive means include a screw member rotatably mounted on said seat back frame, an electric motor operatively connected to said screw member for rotating said screw member, a nut member threadably mounted on said screw member and having projecting means engagable with said link means whereby upon rotation of said electric motor said nut will be moved along the length of said screw member to rotate said link means to move said pressing member.

3. A lumbar support regulating apparatus as set forth in claim 1, wherein said link means is pivotally mounted on said rotatable shaft portion adjacent said spiral spring member.

* * * * *